US005542608A

United States Patent [19]

Kaylor

[11] Patent Number: 5,542,608

[45] **Date of Patent: *Aug. 6, 1996**

[54] ASPIRATING NOZZLES

[75] Inventor: Joseph B. Kaylor, Manassas, Va.

[73] Assignee: Valkyrie Scientific Proprietary, L.C., Reston, Va.

[ * ] Notice: The term of this patent shall not extend beyond the expiration date of Pat. No. 5,330,105.

[21] Appl. No.: 274,274

[22] Filed: Jul. 13, 1994

Related U.S. Application Data

[63] Continuation-in-part of Ser. No. 037,647, Mar. 26, 1993, Pat. No. 5,330,105.

[51] Int. Cl.[6] ..... B05B 1/34; B05B 7/00

[52] U.S. Cl. ..... 239/400; 239/407; 239/427.3; 239/428.5; 239/433; 239/466

[58] Field of Search ..... 239/8–10, 399, 239/400, 403, 405, 427.3, 428.5, 463, 466, 407, 413, 416.5, 427.5, 428, 433, 498, 525, 154, 152, 704, 153, 500, 502; 366/336, 337, 338

[56] References Cited

U.S. PATENT DOCUMENTS

| | | | |
|---|---|---|---|
| 3,939,073 | 2/1976 | Bats | 239/399 X |
| 4,498,786 | 2/1985 | Ruscheweyh | 366/336 |
| 4,692,030 | 9/1987 | Tausher et al. | 366/336 X |

FOREIGN PATENT DOCUMENTS

| | | | |
|---|---|---|---|
| 941630 | 1/1949 | France | 239/466 |

*Primary Examiner*—Andres Kashnikow
*Assistant Examiner*—Lesley D. Morris
*Attorney, Agent, or Firm*—Roland H. Schubert

[57] ABSTRACT

An air aspirating nozzle for propelling a stream of foam or a slurry of solid particulates to a target surface includes a stream shaping member within the nozzle to form a rotating, columnar stream of liquid and air that maintains a high degree of coherence over a considerable throw distance. The stream shaping member includes a cylindrical body portion held axially in place within the nozzle body by a plurality of vanes extending between the body portion and the inner nozzle wall. The vanes are arranged in a forward-raked attitude, and the vane surfaces are configured to impart a rotation to a fluid column passing through the nozzle.

14 Claims, 5 Drawing Sheets

ASPIRATING NOZZLES

CROSS-REFERENCE TO RELATED APPLICATIONS

This application is a continuation-in-part of U.S. patent application Ser. No. 08/037,647 entitled "Aspirating Nozzle and Accessory Systems Therefor" which was filed on Mar. 26, 1993 and issued as U.S. Pat. No. 5,330,105 on Jul. 19, 1994.

TECHNICAL FIELD

This invention relates generally to a gas aspirating nozzle and to accessory systems for providing a supply of liquids and solids to the nozzle.

Specific embodiments of this invention include air aspirating fire fighting nozzles to propel a stream of water or water mixed with foam forming constituents to a fire source and also air aspirating nozzles adapted to propel a slurry of water and particulate solids to impact upon a solid surface.

BACKGROUND ART

There have been a variety of nozzles developed for use in fighting fires and for the production of foams for other purposes. Certain of such nozzles use only water as the extinguishing agent and are known as fog nozzles. Those 25 nozzles produce a dispersed spray of small water droplets projected from the nozzle tip in a generally conical pattern. An example of one such nozzle is described in U.S. Pat. No. 4,653,693.

A second type of nozzle commonly used in fire fighting is the air aspirating foam nozzle and a variety of such nozzles are described in the patent literature. Examples include U.S. Pat. No. 5,058,809 to Carroll et al.; U.S. Pat. No. 5,054,688 to Grindley; and U.S. Pat. No. 4,830,790 to Stevenson. The nozzles described in those exemplary patents all have in common means to aspirate air into a solution of foaming agent and water. Turbulence producing means provided within the nozzle body mix the air and liquid to produce a foam that is projected from the nozzle end.

A nozzle that might be considered a variation on those of the air aspirating type is disclosed in U.S. Pat. No. 5,113,945 to Cable. The Cable patent describes a foam producing nozzle that is supplied air from a pressurized source rather than aspirating atmospheric air for foam production as do the nozzles described in the patents cited above.

Yet other nozzles are of the multifunction type. Those are illustrated by a patent to Steingass, U.S. 4,944,460 and a second patent to Williams et al., U.S. Pat. No. 5,167,285. The nozzle described in the Steingass patent is adapted to spray either water or a mixture of water and a foam concentrate. It is adjustable between a straight stream and fog positions, and can be set to pull atmospheric air into the nozzle to mix with liquid and form a foam. The Williams et al. patent describes a nozzle that has provision for simultaneously discharging a dry powder and a stream of water or water based foam. The dry powder is discharged from a central, axially extending conduit while the liquid stream is discharged in an annular pattern around the stream of discharging powder. The powder, if it mixes at all with the liquid, does so after leaving the nozzle and at some distance therefrom.

Despite the variety of specialized nozzles and extinguishing agent delivery systems known in the prior art, the need for a simple high performance nozzle system capable of operating over a range of water pressures, and especially at low water pressures, to project an air aspirated stream of water or water-foam concentrate for considerable distances has not been met. Further, the art lacks a simple yet reliable system for continuously feeding particulate solids into a flowing liquid stream and thence through a nozzle without the hazard of bridging and clogging. Applicant's nozzle and accessory system meets those needs.

DISCLOSURE OF THE INVENTION

This invention provides a nozzle and accessory systems that can project a tight, coherent, air-aspirated stream of water, water-foam concentrate or a water-solids slurry for a considerable distance to obtain a very short, narrow footprint, or discharge pattern, at the landing point of the liquid stream. Also provided are means to supply either a liquid, which may be a foam concentrate, or a particulate solid, which may be a fire extinguishing agent or an abrasive material, to the nozzle. The nozzle itself includes a tubular body having a stream shaping member disposed axially therein. That stream shaping member defines an annular zone of reduced cross section at the upstream end of the nozzle thereby creating a zone of reduced pressure into which air is aspirated through ports in the nozzle wall. Water or other liquid entering the nozzle is forced to the inner surface of the nozzle wall forming a layer to which a spin is imparted by vane members that also support the stream shaping member axially within the nozzle. Air passes through the liquid stream and travels out of the nozzle end as the central core of a rotating columnar water stream.

Accordingly, it is an object of this invention to provide an improved air aspirating nozzle that can propel a columnar stream of air-aspirated liquid or liquid and solids onto a fire or other target.

It is a further object of this invention to provide an air-aspirating nozzle having means to introduce either a liquid foam concentrate or a steam of particulate solids into the nozzle for mixing with a stream of water supplied to the nozzle.

Another object of this invention is to deliver a stream of water, supersaturated in nitrogen gas, to a fire site.

Yet another object of this invention is to provide improved means and methods for extinguishing fires.

Other objects will become apparent to one skilled in the art from the following description of various modes for carrying out the invention.

MODES FOR CARRYING OUT THE INVENTION

Figure 1:
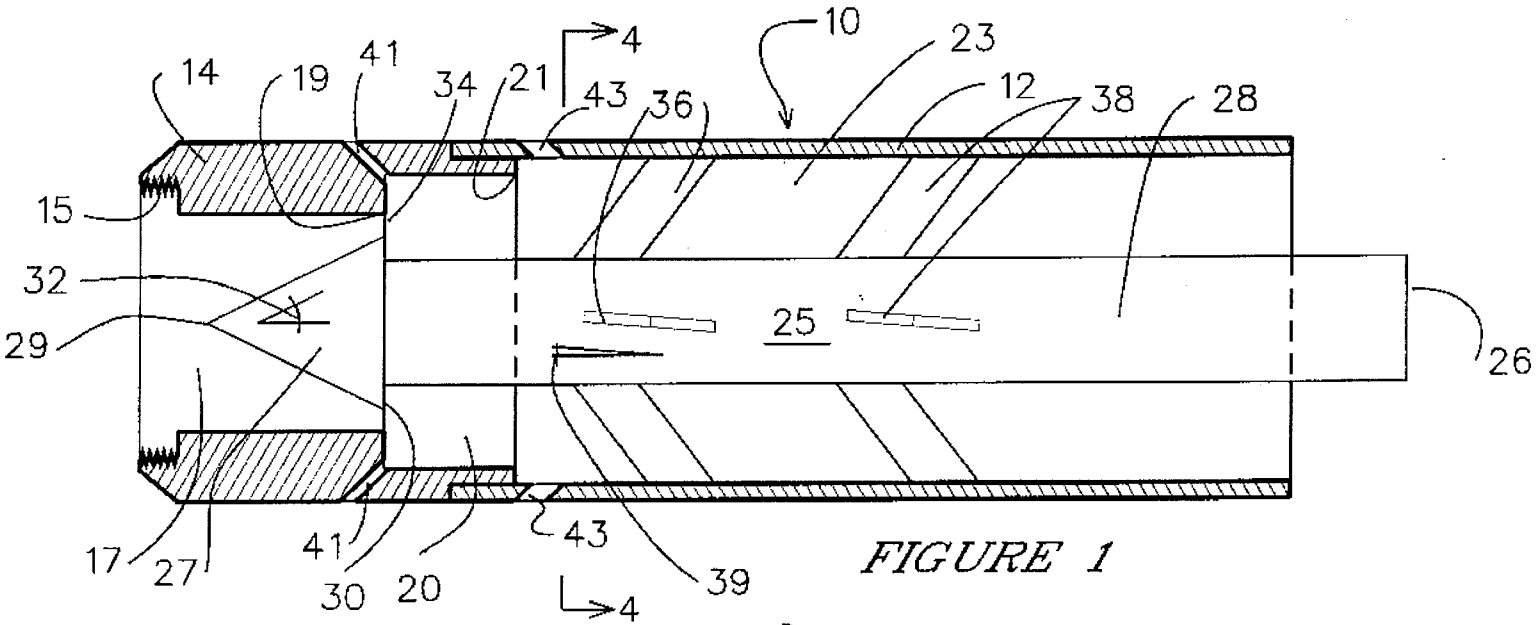
FIG. 1 is a longitudinal sectional view of a first embodiment of the air aspirating nozzle of this invention.

Various embodiments of the invention will be described and discussed in detail with reference to the drawing figures in which like reference numerals refer to the same component or part illustrated in different figures.

Referring first to FIG. 1, there is shown generally at 10 a sectional view of the air aspirating nozzle of this invention. The nozzle itself includes a generally tubular body 12 and a head member 14 of smaller internal diameter than body 12. Head member 14 is adapted for connection to a flow control valve or other accessory at its upstream end through threaded connector portion 15 and forms a generally cylindrical passage 17 downstream of connector 15. The wall of passage 17 preferably tapers inwardly to be of progressively smaller cross sectional area downstream of connector 15 to shoulder 19. At shoulder 19 the diameter of passage 17 increases to form a first zone 20 of enlarged cross sectional area. A second shoulder 21 may be provided a short distance, typically less than the diameter of zone 20, downstream of shoulder 19 to form a second zone 23 of yet larger cross sectional area. Zone 23 is defined by the interior wall of tubular body 12 and extends to the discharge end of the nozzle. The length of the second zone 23 must be greater than its diameter and preferably is between two and ten times its diameter.

A stream shaping means 25 having an end 26, a head member 27, and a body portion 28 is positioned axially within the nozzle. Head member 27 must be a symmetrical body enlarging from forward end 29 to base 30 and preferably is configured as a cone having an apex angle 32 less than 75° and most preferably less than 30°. While a conical shape is preferred for head member 27, it may also be configured as a hemisphere or parabola or other curve. The forward end 29 of head member 27 is positioned to extend into passage 17 while base 30 is positioned adjacent shoulder 19 or just downstream from it. By so positioning base 30 relative to shoulder 19 there is formed an annular fluid channel 34 communicating between passage 17 and first zone 20. The dimensions of base 30 compared with the diameter of passage 17 at shoulder 19 are set such that the area encompassed by channel 34 is substantially smaller than is the cross sectional area of passage 17 at that same point. In a preferred embodiment, the area of channel 34 is less than one-half, and most preferably, less than about than one-third the cross sectional area of passage 17.

Body portion 28 of stream shaping means 25 comprises a cylinder extending axially from base 30 to a point adjacent the end of tubular body 12 and preferably extending beyond the end of body 12 as is shown in the drawing. Diameter of the cylindrical body portion 28 must be no greater than that of base 30 and appropriately is some 60% to 90% that of base 30. A set of forward vanes 36 and a set of rearward vanes 38 extend between and are fixed to the outer surface of body portion 28 and the inner wall of tubular body 12 to hold stream shaping means 25 in a fixed position within nozzle 10. Each set of vanes 36 and 38 consist of a plurality, preferably three or four, individual vane members disposed at a slight angle 39 to the axis of the nozzle. That vane angle 39 is set to give a twist or rotation of fluid passing through the nozzle much as does the rifling in an artillery piece. Angle 39 is uniform for all vane members and is preferably set at less than about 10° to give one full rotation to a fluid column expelled from the nozzle for every 10 to 50 nozzle diameters.

Figure 2:
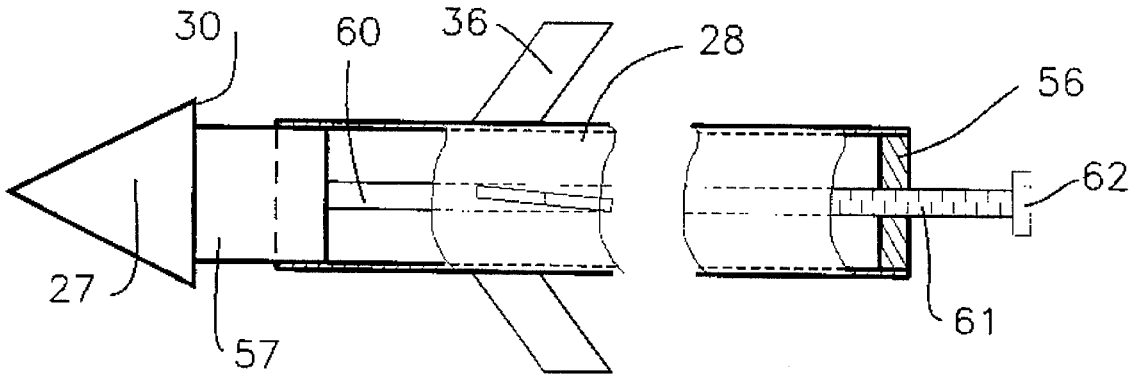
FIG. 2 is a partial sectional view of the stream shaping element of the air aspirating nozzle of FIG. 1.

Turning now to FIG. 2, there is shown another embodiment of the stream shaper means 25. In this embodiment, body portion 28 comprises a hollow tube having a closure means 56 at its downstream end. Base 30 of head member 27 is mounted upon neck 57 that is adapted to slidingly fit within the end of tubular body 28. A rod 60 is attached to neck 57 and extends the length of tubular body 28 and through closure 56. Rod 60 is threaded at its downstream end 61 and threadably mates with closure 56 so that the effective length of rod 60 between closure 56 and neck 57 is adjustable by turning nut 62 mounted on the end of rod 60. Because tubular body 28 is fixed to the nozzle body 12 through vanes 36, the effect of turning nut 62 is to move head member 27 axially relative to shoulder 19 (see FIG. 1). It has been found that performance of the nozzle, particularly its throw distance, varies with the pressure of liquid fed to the nozzle, and that performance can be optimized by adjustment of base 30 relative to shoulder 19. The embodiment of FIG. 2 allows such adjustment.

Figure 3:
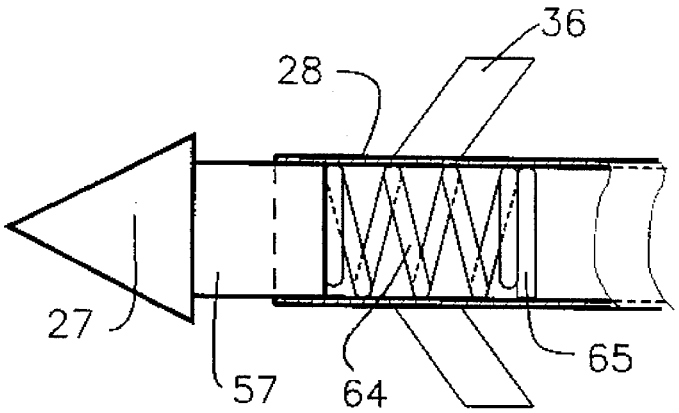
FIG. 3 is a fragmentary sectional view of another embodiment of the stream shaping element.

FIG. 3 illustrates yet another embodiment of the stream shaping means 25. As in FIG. 2, head member 27 is provided with neck 57 that slidingly fits within tubular body member 28. Neck 57 is fixed to one end of a spring 64 that acts under compression to allow head member 27 to move backwardly under a pressure force. The other end of spring 64 rests upon stop means 65 which is fixed within tube 28. As with the embodiment of FIG. 2, body member 28 is held within the nozzle by vanes 36. In operation, the pressure of liquid flowing through the nozzle pushes against head member 27 and moves it in the direction of flow by compression of spring 64. The amount of movement increases as fluid pressure increases thus providing an automatic adjustment to optimize nozzle performance over a broad range of operating pressures.

Figure 4:
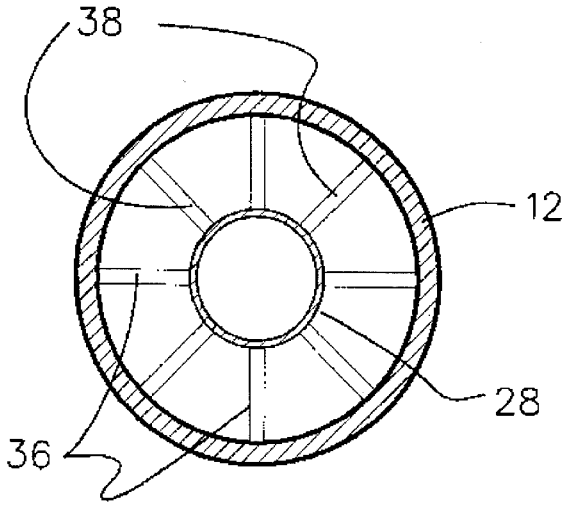
FIG. 4 is a cross sectional view of the nozzle taken along line 4—4 of FIG. 1.

The nozzle embodiment of FIG. 1 has been described as using a forward and a rearward set of vanes to impart a twist to the fluids and to secure stream shaper means 25 within the nozzle. The rearward set of vanes 36 need not be aligned with the forward set of vanes 38. Rather, the two sets of vanes may be rotationally offset as is shown in FIG. 4. Further, rather than providing two sets of vanes, a single set of vanes may be used with some sacrifice in performance and structural strength. Likewise, three or even more sets of vanes, rather than just two, may be used if wanted. Other embodiments of this invention may employ but a single set of air aspirating ports rather than two as is depicted in the FIG. 1 embodiment.

Another embodiment of the nozzle of this invention is depicted in FIGS. 5 through 10 and will be described with reference to all of those Figures. As with the FIG. 1 nozzle, the nozzle body or barrel 12 is a generally tubular member. It attaches at its upstream end to a boss 151 that is shown in greater detail in FIGS. 8, 9 and 10. Also common with the nozzle of FIG. 1 is a stream shaping means positioned axially in nozzle barrel 12. That stream shaping means includes a tubular body portion 28 held in place by a set of upstream vanes 153 and a set of downstream vanes 155. A head member 27 is mounted upon one end of a cylindrical neck 57 sized to slidingly fit into the upstream end of tubular body 28. The other neck end rests upon spring follower block 157 that is arranged to press upon spring 64.

Boss 151 is formed as a stepped cylinder having three sections, each section of a different exterior diameter. An axially aligned cylindrical bore 160 of uniform diameter extends through the boss. The front, or upstream, section 162 of boss 151 is the smaller diameter part of the boss. The free end of section 162 is arranged for attachment to a hose or monitor by means of a speed nut, or a quick-disconnect coupler, or through simple threads (not shown) while the other section end steps to middle section 164 forming a face 165. Downstream section 166 is of smaller diameter than is the middle section and is sized to fit within the upstream end of the nozzle barrel 12.

Figure 7:
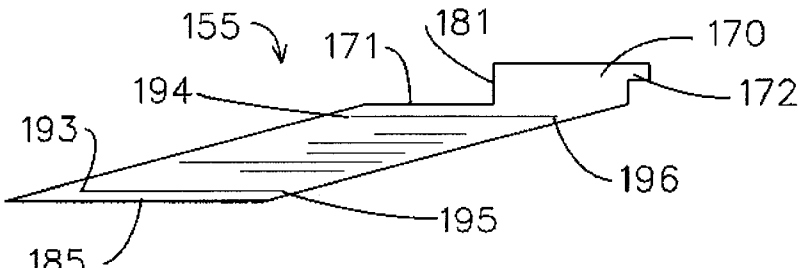
FIG. 7 depicts a downstream vane used with the nozzle of FIG. 5.
Figure 6:
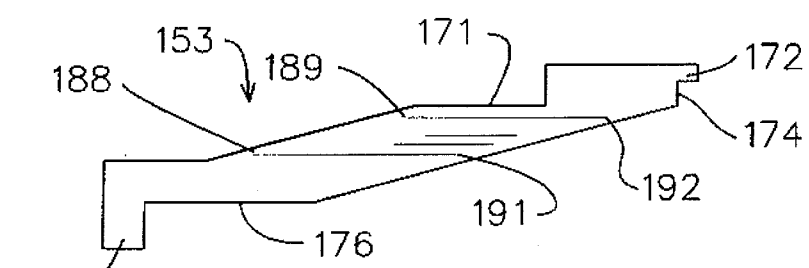
FIG. 6 depicts an upstream vane used with the nozzle of FIG. 5.

FIGS. 6 and 7 show the shape of upstream vanes 153 and downstream vanes 155 respectively. Both vanes are formed of sheet stock, suitably stainless steel or aluminum, the thickness of each vane being much less than its length. Multiple functions are performed by the vanes. As is described in greater detail later, the vanes serve to hold the tubular body 28 of the stream shaping means in place within the nozzle barrel 12, to guide the movement of neck 57, to limit the travel of head member 27, to retain spring 64 in position, and to impart a controlled rotational motion to the water stream as it traverses the nozzle.

The inner, downstream ends of both vanes 153 and 155 terminate in a rectangular projection 170 that extends perpendicularly from shoulder 171 and has a protruding ear 172. Projection 170 fits through a slot cut in tubular member 28 (see FIG. 5) with shoulder 171 resting on the external tube surface and protruding ear 172 contacting the inner tube surface. Ledge 174 of vane 153, at the downstream end of projection 170 below ear 172, acts as a stop for spring follower block 157 while the inner surface 173 of projection 170 serves as a guide for neck 57. The outer, upstream end of vane 153 is in the form of an L-shaped tab having an outer face 176 that, when assembled, rests in a contacting relationship along the inner surface of nozzle barrel 12. A tab leg 177 projects outwardly from tab face 176 to fit within a slot 179 of boss 151 and is held in place within the slot by the end of barrel 12.

As was previously described, the inner, downstream end of vanes 155 are similar in conformation to vanes 153 but serve a somewhat different function. Upstream face 181 of rectangular projection 170 provides a stay for spring stop block 183 (FIG. 5) while the outer, upstream end of the vane is configured so that outer face rests along the inner surface of barrel 12.

Both vanes 153 and 155 are aligned in a strictly parallel relationship to the longitudinal axis of the nozzle instead of being set at a small angle 39 as are the vanes of the FIG. 1 embodiment. Yet, vanes 153 and 155 act upon the fluid stream passing through the nozzle to impart a twist or rotation to the fluid. A rotational force is generated by shaping one side of each vane so that the fluid pressure on one side of the vane is less than that on the other side. In short, each vane is configured to function much as does the air foil surface of an aircraft wing or other lift body. In practice, suitable rotational forces are applied to the fluid by milling one vane side in a fashion such that the vane thickness decreases slightly, upstream to downstream, over much of the vane area contacting the fluid.

Both upstream vanes 153 and downstream vanes 155 are arranged in a forward-raked attitude, opposite to the vane attitude of the FIG. 1 embodiment. That is, vane 153 is arranged such that its tab end 177 is upstream from its inner shoulder 171 and ear 172. Similarly, vane 155 is arranged such that its outer face 185 is upstream from its inner shoulder and ear. The degree of raking, as defined by angle 180 measured between a downstream vane edge and the nozzle wall, may range from about 10° to 60°, but most preferably is set between 10° and 30°. The forward-raked attitude of the vanes has been found to enhance control over the rotational forces imparted to the fluid stream passing through the nozzle, and therefore is a preferred embodiment of the invention.

As shown in FIG. 6, the fluid contacting surface of vane 153, between points 188 and 189 on the upstream edge and points 191 and 192 on the downstream edge, is shaped such that edge 191–192 is modestly thinner than is edge 188–189. The extent of thinning, from point 188 to point 191 and from point 189 to point 192, may be conveniently expressed in mathematical terms as a negative slope. It has been found that a slope between about −0.01 to −0.05 is sufficient to impart the desired degree of rotation to fluid passing through the nozzle. The thinning of the fluid contacting surface may conveniently be uniform, upstream to downstream. That is, a line drawn between points 188 and 191 would be of uniform slope. Performance of the nozzle appears to be enhanced if there is also provided an inboard (toward the center) deflection to the fluid contacting surface. In other words, a line drawn between points 188 and 191 would show a small inboard deflection in addition to the thinning. The angle of deflection usefully may range from about 1° to about 10°. It is preferred that the fluid contacting surface of downstream vanes 155, bounded by points 193, 194, 195 and 196 (FIG. 7), conforms in its slope and deflection angle to that of the upstream vanes 153. In this way, uniform rotational forces are applied to the fluid stream.

Figure 10:
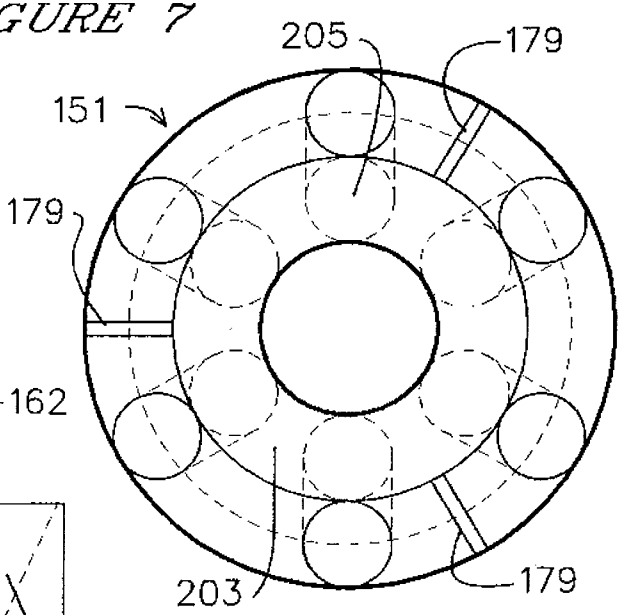
FIG. 10 is a downstream end view of the boss element of FIG. 8.
Figure 8:
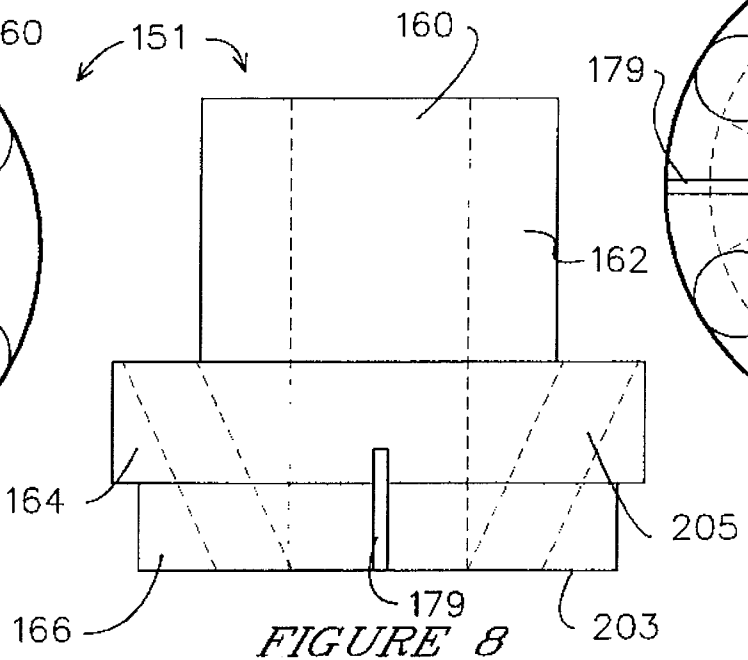
FIG. 8 is a side view of the nozzle boss element of FIG. 5.
Figure 9:
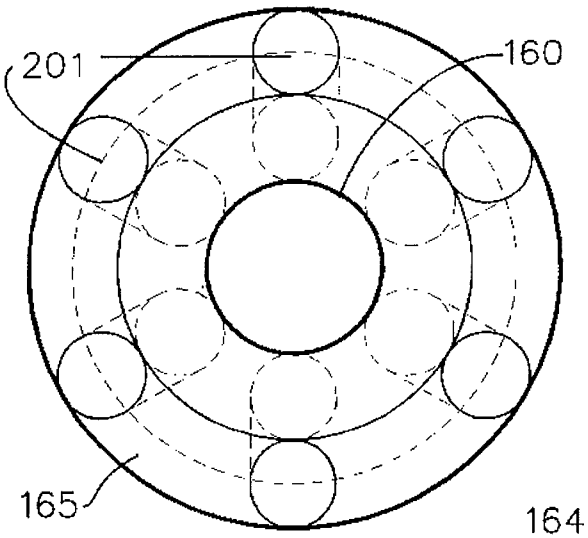
FIG. 9 is an upstream end view of the boss element of FIG. 8.

Reference is now made to the nozzle boss 151 that is detailed in FIGS. 8, 9 and 10. A plurality of inclined holes 201 are drilled from outer boss face 165 to inner boss face 203 forming cylindrical channels 205 communicating between the atmosphere and the interior of the nozzle. During use of the nozzle, water under pressure flows past head member 27 and through annular fluid channel 34. The conical taper of head member 27 directs the water outwardly to the inner surface of nozzle body 12 that, in turn, creates a reduced pressure zone downstream of head member 27 and adjacent the surface of neck 57 and body member 28. Air sucked into the nozzle through channels 205 is forced through the outwardly directed layer of water issuing from fluid channel 34 to reach the reduced pressure zone. In so doing, the water becomes super saturated with gas. The force of flowing water under pressure on head member 27 also compresses spring 64 between the spring follower block 157 and spring stop block 183. Consequently, the area of annular fluid channel 34 increases thus adjusting the flow characteristics of the nozzle to the supplied water pressure.

Figure 11:
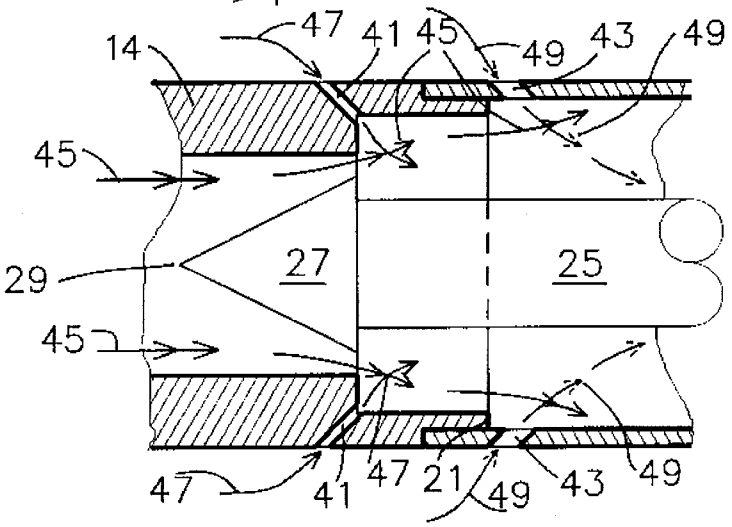
FIG. 11 is a diagrammatic sectional view showing the flow of liquid and gas within the nozzle.
Figure 5:
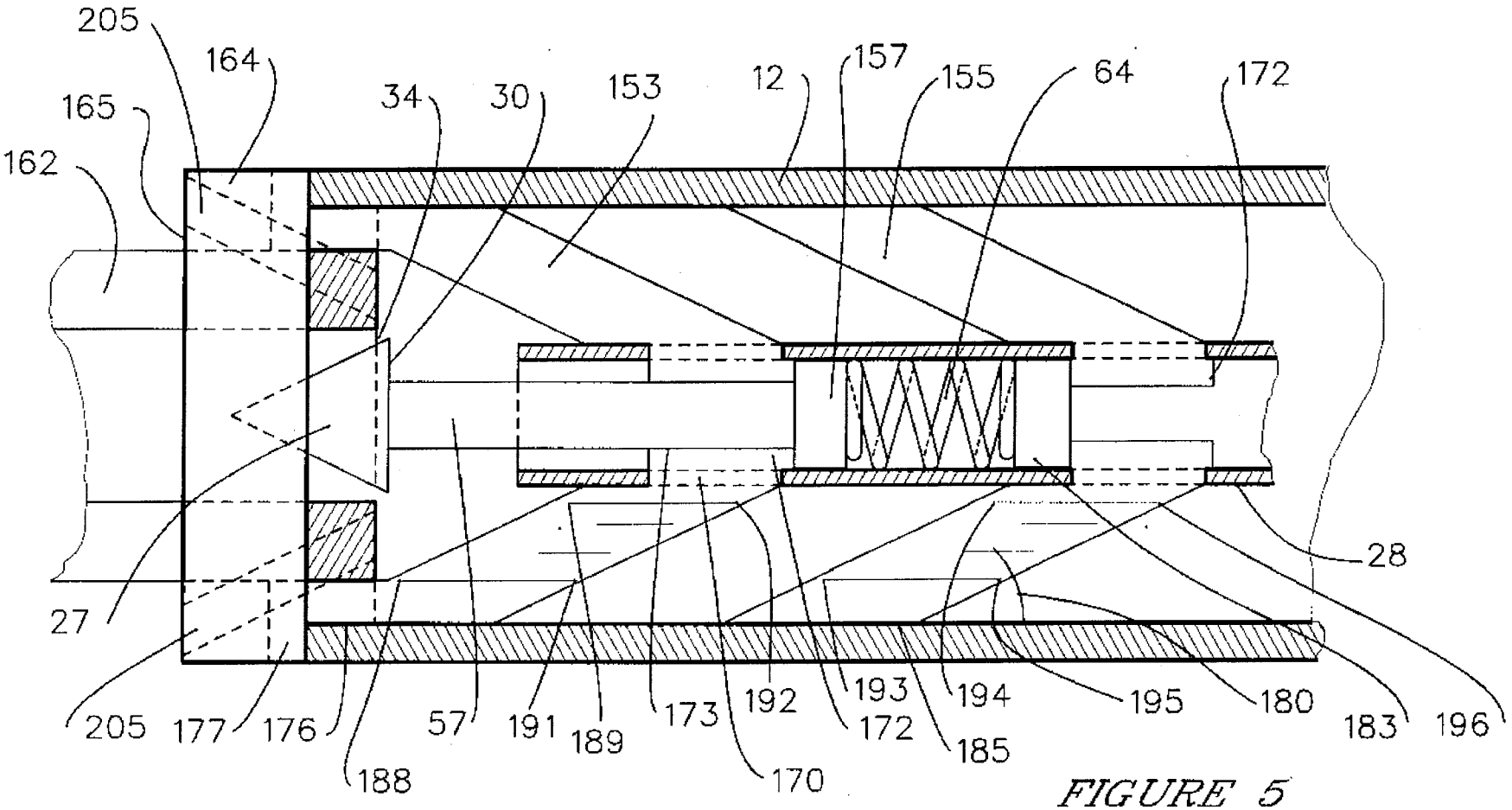
FIG. 5 is a longitudinal sectional view of another embodiment of the aspirating nozzle of this invention.

Referring now to FIG. 11 in association with FIGS. 1 and 5, air or other gas is aspirated into the nozzle by way of primary ports 41 spaced around the periphery of head member 14 to enter the nozzle interior at or adjacent first shoulder 19. Additional air may be aspirated into the nozzle further downstream through a set of secondary ports 43 positioned at or adjacent second shoulder 21. A liquid stream that may be water from a pump or main, or water mixed with a foam concentrate, is supplied to the nozzle and flows in the path shown by the double headed arrows 45. As the water passes through channel 34 its velocity is increased because of the constricted area defined by the channel as compared to upstream passage 17. The liquid flow is also directed to the periphery of zone 20 by acting against the surface of head member 27 and, in passing shoulder 19, creates a reduced pressure zone, or partial vacuum, just downstream of base 30 and adjacent the surface of the cylindrical body portion 28 of stream shaping means 25. In order to reach that zone of reduced pressure, air flows in a pattern depicted by the single headed arrows 47 crossing through that layer of liquid flowing through fluid channel 34 to the inside surface of housing 12. In so doing intense mixing of the air and liquid occurs, and the liquid becomes supersaturated in gas. If the liquid comprises a mixture of water and foam concentrate, the mixing produces a dense foam.

The provision of secondary ports 43, in the FIG. 1 embodiment, in association with second shoulder 21 results in the creation of another zone of reduced pressure, or partial vacuum, just downstream of shoulder 21. Air entering through secondary ports 43 again has to pass through a layer of flowing liquid in the path depicted by arrows 49 resulting in further intense mixing of the air and liquid. The air and liquid streams form a columnar arrangement as the streams progress through the nozzle body with the liquid forming a ring or wall surrounding an air core. A twist or spin is imparted to both the liquid and the gas streams as they pass first the forward set of vanes 36 and then the rearward set of vanes 38 of the FIG. 1 nozzle. A similar twist or spin is imparted to the fluid in the nozzle of FIG. 5 by the action of upstream vanes 153 and downstream vanes 155. It is preferred in both nozzle embodiments that the vanes be configured to impart one full revolution to a fluid column expelled from the nozzle end for every 10 to 50 nozzle diameters.

Figure 12:
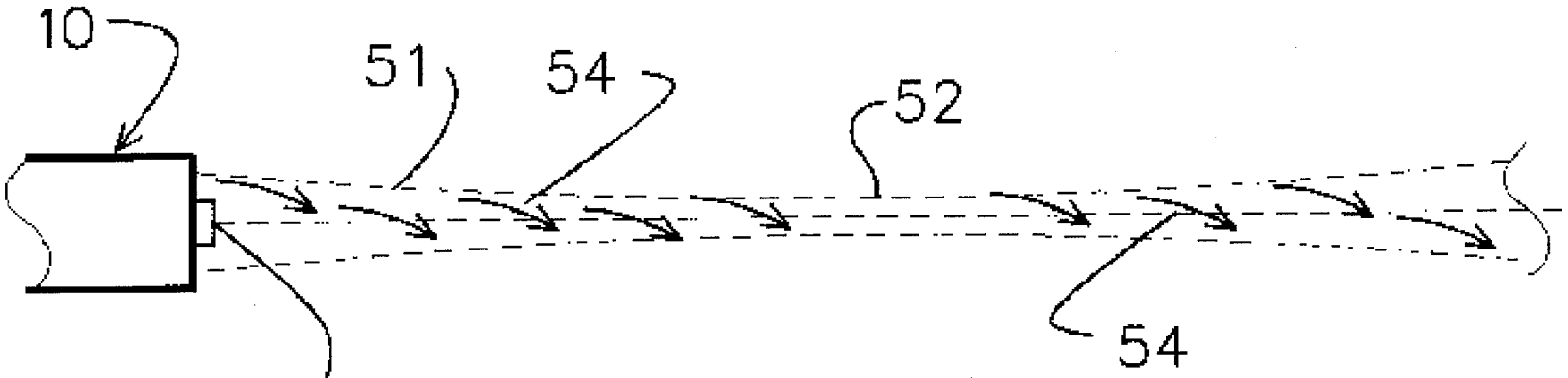
FIG. 12 is an illustration of the column of liquid and gas projected out of the nozzle of FIGS. 1 and 5.

Referring now to FIG. 12 as well, as a columnar stream of liquid and air 51 leaving the nozzle further reduces in diameter for a considerable distance, typically some 5 to 20 feet beyond the nozzle end, to point 52. After that, columnar stream 51 gradually enlarges in diameter. All the while, stream 51 is rotating in the manner shown by arrows 54 as is evident through observation using high speed photography. As the stream 51 impacts upon a surface, the air core within the liquid column again must interact with the liquid layer resulting in a much more "active" water or foam impact than is produced by conventional nozzles. The twisting, or rifling, effect imparted to stream 51 by its passage through the nozzle 10 also results in a throw distance considerably greater than that obtainable using conventional air aspirating nozzles.

The nozzle of this invention has been tested in comparison to conventional fire fighting nozzles in controlled, block house burn tests. Such tests are conducted by placing a standard quantity of combustible material in an enclosure (usually built of concrete), igniting the combustibles, and allowing the fire to develop. After that, the fire is extinguished using the nozzle system under test. The effectiveness of each nozzle is judged by measuring the length of time required to first knock down and then extinguish the fire and by measuring the amount of water applied to the fire to obtain extinguishment.

There has been observed a totally unexpected enhancement in the fire extinguishing capabilities of water when delivered to a fire through the nozzle of this invention, as compared to the same quantity of water delivered by conventional fire fighting nozzles. In certain of those tests, the nozzle of this invention extinguished a block house fire in less than half the time using less than one fifth the water required by conventional nozzles. Water was supplied at the same pressure, from the same source, through the same hose for the comparative tests; only the nozzles were changed.

Further exploration of this phenomenon determined that the inventive nozzle produced an extremely high level of gas supersaturation in the water projected from the nozzle. Water landing in an impact area literally appeared to boil, much like the effect one sees from a spilled carbonated beverage. In further testing, a nozzle stream was directed into the bung of a closed drum that had previously been cleaned and flushed with air. Gas separated from the fluid stream entering the drum issued from another port. That gas was tested and it did not support combustion. Conventional nozzles did not produce that effect.

Based upon these data and observations, it was concluded that operation of the nozzle created a very high level of nitrogen supersaturation by forcing air through a relatively high pressure curtain of water. It is believed that nitrogen preferentially goes into solution under conditions occurring in the nozzle, or that oxygen tends to preferentially escape from solution, or both. There are disclosures in the literature that recognize incidents of nitrogen supersaturation resulting from agitated contact of water with air. For example, persistence of high levels of nitrogen supersaturation in the tailrace downstream of dams is a well-documented phenomenon. Levels of nitrogen as high as 145% of saturation have been routinely recorded in the tailrace waters of the John Day Dam on the Columbia river.

As may now be more fully appreciated, the means and methods of this invention, as set out in the disclosure, provide enhanced nozzle performance and other advantages not present in prior art devices and techniques. It will also be recognized by those skilled in this art that many modifications of the devices and techniques that have been described can be made without departing from the spirit and scope of the invention.

I claim:

1. In a nozzle having a stream shaping means positioned within a cylindrical nozzle body along the longitudinal axis thereof, said nozzle body having an outer and an inner nozzle wall, said nozzle having an upstream end and a downstream end, and having a plurality of vanes extending between the stream shaping means and the inner nozzle wall to hold the stream shaping means fixed relative to the nozzle body, each of said vanes having a first end and a second end, the improvement comprising:

arranging all of said vanes in a forward-raked attitude wherein the first end of each of said vanes is positioned at the inner nozzle wall, and the other end of each of said vanes is fixed to said stream shaping means, each of said vanes positioned so that said first vane end is located upstream of said other vane end, all of said vanes arranged to act upon a fluid passing through the nozzle to impart a rotation to said fluid, whereby said fluid is discharged from the downstream nozzle end as a rotating columnar stream.

2. The nozzle of claim 1 wherein a surface of each of said vanes is shaped such that the pressure on a fluid passing through the nozzle is less on one side of each vane than on the other vane side.

3. The nozzle of claim 1 wherein each of said vanes is aligned parallel to said stream shaping means, and wherein the thickness of each of said vanes decreases, thereby producing a thinning of said vanes, upstream to downstream, over a substantial portion of the fluid contacting surface of one vane side.

4. The nozzle of claim 3 wherein the thinning of said vanes is uniform, upstream to downstream, and the extent of vane thinning, expressed as a negative slope, is in the range of 0.01 to 0.05.

5. The nozzle of claim 4 wherein the slope direction of the thinned vane area is deflected inward, toward the nozzle center, at an angle ranging between 1° and 10°.

6. The nozzle of claim 1 wherein said stream shaping means includes a head portion and a cylindrical body portion; and wherein said vanes are arranged in two sets, one set upstream of the other set, each set including at least three identical vanes.

7. The nozzle of claim 6 wherein each vane in said upstream set terminates at its downstream end in a rectangular projection having a protruding ear, said projection arranged to fit through a slot in the wall of said body portion, and said ear arranged to lock said vane in place within said slot.

8. The nozzle of claim 6 wherein each vane in said downstream set terminates at its downstream end in a rectangular projection having a protruding ear, said projection arranged to fit through a slot in the wall of said body portion and said ear arranged to lock said vane in place within said slot, and wherein the other end of each said vane terminates in a face arranged to rest along the inner surface of said nozzle body.

9. The nozzle of claim 6 wherein the upstream end of said nozzle body is joined to a boss member, said boss having an axially aligned bore of smaller diameter than that of said nozzle body, the exterior of said boss having three sections, an upstream, a center and a downstream section, each of a different diameter, the downstream section sized to fit within the upstream end of said nozzle body, and wherein the head portion of said stream shaping means in configured as a cone having an apex and a base, the apex angle of said cone being less than 75°, and the cone base being positioned adjacent the downstream end of said boss member.

10. The nozzle of claim 9 wherein said upstream boss section is of smaller diameter than is said downstream section, wherein said center section is-larger than is said downstream section, and wherein a plurality of inclined channels are provided between a first boss face formed between said upstream and center boss sections, and a second boss face extending between said axially aligned bore and the exterior of said downstream boss section, said channels allowing fluid communication between the interior and the exterior of said nozzle.

11. The nozzle of claim 9 including spring means disposed within the body portion of said stream shaping means, and arranged to allow said head portion to move axially, relative to said body portion, as fluid flow within the nozzle is increased.

12. The nozzle of claim 11 wherein said spring means is restrained within said body portion between the rectangular projections of said upstream vanes and the rectangular projections of said downstream vanes.

13. The nozzle of claim 1 wherein said vanes are configured to impart one full revolution to a fluid column expelled from the nozzle end for every 10 to 50 nozzle diameters.

14. A method for extinguishing fire comprising:

passing a stream of water through a nozzle, the cross-sectional area of said nozzle increasing in a stepwise fashion as the water progresses through the nozzle;

directing the water to the inner nozzle wall as it passes a point whereat the nozzle cross-sectional area increases to thereby form a water layer flowing along the inner nozzle wall, and a zone of reduced pressure in the nozzle interior;

aspirating air from outside of the nozzle, through said water layer, and into said zone of reduced pressure by way of ports located in the nozzle wall at that point whereat the cross-sectional area increases, to thereby supersaturate the water stream with nitrogen;

imparting a rotation to the water and air as the streams progress down the nozzle;

discharging a columnar stream of water, supersaturated in nitrogen, from the nozzle; and directing the stream onto a fire.

* * * * *